United States Patent [19]

St. Amand

[11] Patent Number: 4,779,768

[45] Date of Patent: Oct. 25, 1988

[54] VOLUMETRIC DISPENSING PIPETTE

[75] Inventor: Elmer F. St. Amand, San Fernando, Calif.

[73] Assignee: St. Amand Manufacturing Co., Inc., San Fernando, Calif.

[21] Appl. No.: 77,503

[22] Filed: Jul. 24, 1987

[51] Int. Cl.[4] ..... B65D 47/18

[52] U.S. Cl. ..... 222/209; 222/215; 222/130; 222/420; 422/100; 401/185; 604/295; 73/864.11; 141/24; 141/26; D24/55

[58] Field of Search ..... 222/130, 209, 215, 420, 222/421; 422/100, 99; 141/24, 23, 25, 26, 21, 22; 73/864.11; 604/295; 401/184, 185, 183; D24/55

[56] References Cited

U.S. PATENT DOCUMENTS

| | | | |
|---|---|---|---|
| Re. 31,555 | 4/1984 | Garren et al. | 222/209 X |
| D. 250,599 | 12/1978 | St. Amand | 73/864.11 X |
| 1,594,370 | 8/1926 | Kubota | 422/100 |
| 3,718,133 | 2/1973 | Perry et al. | 73/864.11 X |
| 3,748,909 | 7/1973 | Kuo | 73/864.11 |
| 3,938,392 | 2/1976 | Rodrigues | 73/864.11 |
| 4,212,204 | 7/1980 | St. Amand | 222/420 X |
| 4,563,104 | 1/1986 | Saint-Amand | 222/420 X |

*Primary Examiner*—Joseph J. Rolla
*Assistant Examiner*—David H. Bollinger
*Attorney, Agent, or Firm*—James E. Brunton

[57] ABSTRACT

A one-piece, blow molded pipette for dispensing precise volumetric quantities of fluid. The pipette includes a strategically positioned overflow reservoir and is uniquely configured so as to precisely control the flow paths of air and fluid within the pipette so as to positively preclude the accidental dispensing of a volumetric quantity of fluid greater than the volume of the tubular portion of the device.

10 Claims, 3 Drawing Sheets

12
14
16
18
20
22
24
26
28
30
32
32a
32b
32c

VOLUMETRIC DISPENSING PIPETTE

BACKGROUND OF THE INVENTION

1. Field of the Invention

The present invention relates generally to pipettes, and more particularly to a single-piece inexpensive, disposable volumetric dispensing pipette which delivers a precise, reproducible volumetric quantity of liquid.

2. Discussion of the Prior Art

Various types of devices are known for dispensing a volumetric quantity of liquid, such as standard glass and plastic pasteur pipettes, serological pipettes, calibrated capillary tubes, conventional medicine or eye droppers, air and positive displacement pipettes and syringes. These devices are, for the most part, inaccurate or expensive to manufacture.

U.S. Pat. No. 4,563,104, issued to the present inventor, discloses an improved, high-accuracy liquid dispensing pipette which delivers uniform drops of liquid of given sizes.

Other patents of which the present inventor is aware and which comprise the most pertinent art known to the inventor are British Patent Specification No. 1,031,641; U.S. Pat. Nos. D250,599 and D260,434 issued to the present inventor; U.S. Pat. No. RE 31,555 issued to Garren, U.S. Pat. No. 4,212,204 issued to the present inventor, U.S. Pat. No. 3,748,909 issued to Kuo, and U.S. Pat. No. 3,938,909 issued to Rodrigues.

A drawback common to all prior art pipettes of an inexpensive, disposable type is their inability to reproducibly deliver precise volumetric quantities of liquid. As will be appreciated from the discussion which follows, the improved pipette of the present invention uniquely overcomes this drawback and provides an inexpensive, blow-molded, single piece device capable of dispensing extremely accurate volumes of liquid.

SUMMARY OF THE INVENTION

It is an object of the present invention to provide a simple, one-piece transfer pipette which can repeatedly dispense precise volumetric quantities of fluid.

Another object of the invention is to provide a pipette of the aforementioned character which can be blow-molded as an integral unit from unsaturated hydrocarbon materials selected from the polyolefin group.

Another object of the invention is to provide a pipette of the character described in which the volume of liquid dispensed is a direct function of the inside diameter and length of the tubular portion of the pipette.

Another object of the invention is to provide a pipette as described in the preceding paragraphs which is uniquely configured so as to precisely control the flow paths of air and fluid within the pipette so as to positively preclude the accidental dispensing of a volumetric quantity of fluid greater than the volume of the tubular portion of the device.

A further object of the invention is to provide a pipette of the class described which can be very inexpensively produced in large quantities making it economically feasible to dispose of the device after use.

In summary, these and other objects of the invention are realized by an improved volumetric dispensing pipette comprising an elongated hollow tube having a centrally disposed, axially extending fluid passageway of predetermined size having upper and lower ends, the lower end being open to atmosphere; a longitudinally extending planar web integrally formed with the tube proximate its upper end; at least one fluid overflow reservoir integrally formed with the planar web, the fluid reservoir, or reservoirs, being axially displaced from the fluid passageway of the tube and in communication therewith via a first conduit which extends substantially perpendicular to the fluid passageway; and a yieldably deformable hollow bulb also integrally formed with the planar web. The hollow bulb is in communication with the fluid reservoir via a second conduit interconnecting the hollow bulb and the fluid reservoir. Due to the circuitous fluid path between the fluid passageway of the tube and the hollow bulb any excess fluid drawn into the device will flow into the fluid reservoir and will be prevented from reaching the hollow bulb. This fact, coupled with the unique placement of the fluid overflow reservoirs, insures that when the fluid is ejected from the device by squeezing the hollow bulb only the fluid contained in the passageway of the tube will be dispensed.

DESCRIPTION OF THE INVENTION

Figures 1, 2, 3, 4, 5:
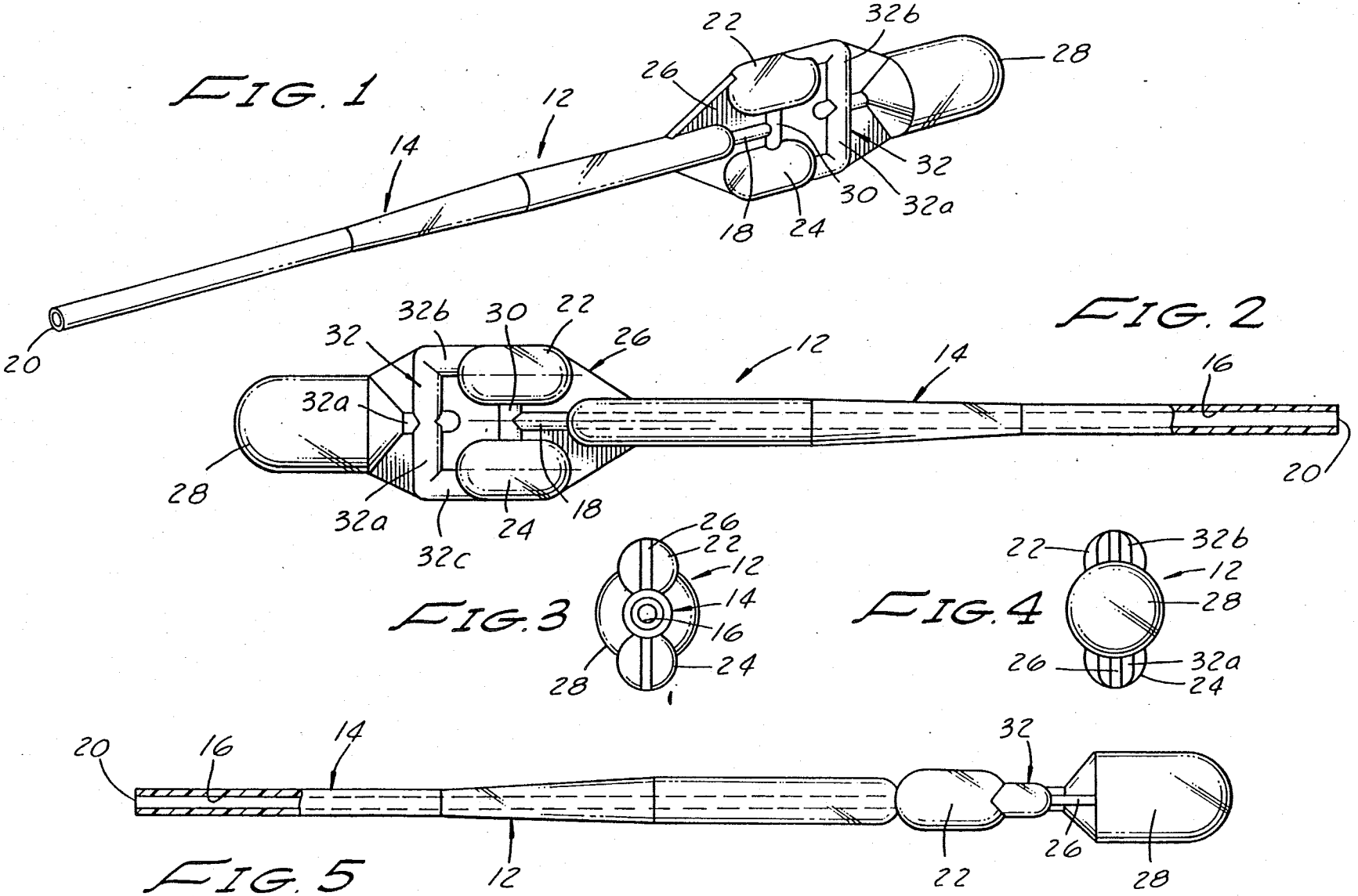
FIG. 1 is a generally perspective view of one form of the pipette of the present invention.
FIG. 2 is a side view of the pipette illustrated in FIG. 1.
FIG. 3 is a right-end view of the pipette shown in FIG. 2.
FIG. 4 is a left-end view of the pipette shown in FIG. 2.
FIG. 5 is a top view of the pipette shown in FIG. 2.

Referring to the drawings and particularly to FIGS. 1 through 5 thereof, one form of volumetric dispensing pipette of the present invention is there shown and is designated generally by the numeral 12. The pipette includes an elongated hollow tube 14 having an axially extending fluid passageway 16 of predetermined size. As best seen in FIG. 2, passageway 16 has an upper end 18 and a lower end 20, which is open to atmosphere.

Connected to tube 14 proximate the upper or left end thereof as viewed in FIG. 2, is structural means 26 for structurally supporting a pair of transversely spaced apart, generally bulb shaped, fluid reservoirs 22 and 24 and a yieldably deformable hollow squeeze bulb 28. Bulb 28 is formed so that squeezing and then releasing the bulb will cause a volume of liquid to be drawn into tube 14 which is slightly greater than the volume of passageway 16. An important feature of the invention is that the longitudinal centerlines of reservoirs 22 and 24 are transversely spaced from the longitudinal centerline of passageway 16 of tube 14. Further, as seen in FIG. 2, reservoirs 22 and 24 are disposed intermediate squeeze bulb 28 and the upper end 18 of fluid passageway 16.

A fluid reservoir connecting conduit 30 interconnects first and second fluid reservoirs 22 and 24 and extends generally perpendicularly to the axial centerline of tube 14. As best seen in FIG. 2, the upper end 18 of fluid passageway 16 interconnects with conduit 30 proximate the center portion thereof.

A second fluid conduit 32 interconnects squeeze bulb 28 with fluid reservoirs 22 and 24. In the form of the invention shown in FIGS 1 through 5, conduit 32 includes a first base leg 32*a* which extends generally perpendicular to the axial centerline of tube 14, a second leg 32*b*, which interconnects fluid reservoir 22 with leg 32*a*; and a third leg 32*c*, which interconnects fluid reservoir 24 with leg 32*a* of conduit 32. As best seen in FIG. 2, the outlet passageway 28*a* of bulb 28 interconnects with conduit 32 proximate the center portion thereof.

It is readily apparent from a study of FIGS. 1 and 2 that conduits 30 and 32, along with bulbs 22 and 24 provide a highly circuitous fluid flow path between squeeze bulb 28 and the upper end 18 of fluid passageway 16 of tube 14. With this novel construction, fluid being drawn into passageway 16 of tube 14 by squeezing and then releasing squeeze bulb 28, has no direct flow path leading to squeeze bulb 28. Rather fluid flowing inwardly through the fluid passageway of tube 14 will strike the upper wall of transverse conduit 30 and will be directed through conduit 30 into one or both of the fluid reservoirs 22 and 24. Due to the novel U-shaped configuration of conduit 32, fluid flowing into overflow reservoirs 22 and 24 cannot find its way into squeeze bulb 28. Accordingly, any excess fluid drawn into tube 14 above and beyond that required to fill passageway 16 will be forced exclusively into the lower portions of reservoirs 22 and 24 leaving passageway 16 completely filled with fluid. By then once more squeezing bulb 28 air pressure will be directed toward passageway 16 via conduits 30 and 32 and the precise volume of fluid necessary to fill passageway 16 will be ejected from the device. By knowing the volume of passageway 16, it is apparent that a precisely predetermined quantity of fluid equal to this volume ca be repeatedly dispensed from the pipette.

In practice, it is highly desirable that the pipette 12 be blowmolded in a single unit from unsaturated hydrocarbon materials selected from the polyolefin group. The hydrocarbon materials from this group which have provided the best results are polyethylene and polypropylene, although other members of the group can be used to satisfy the particular end product applications of the device. Using blowmolding techniques, the devices can be inexpensively produced in extremely large volumes.

Figure 6:
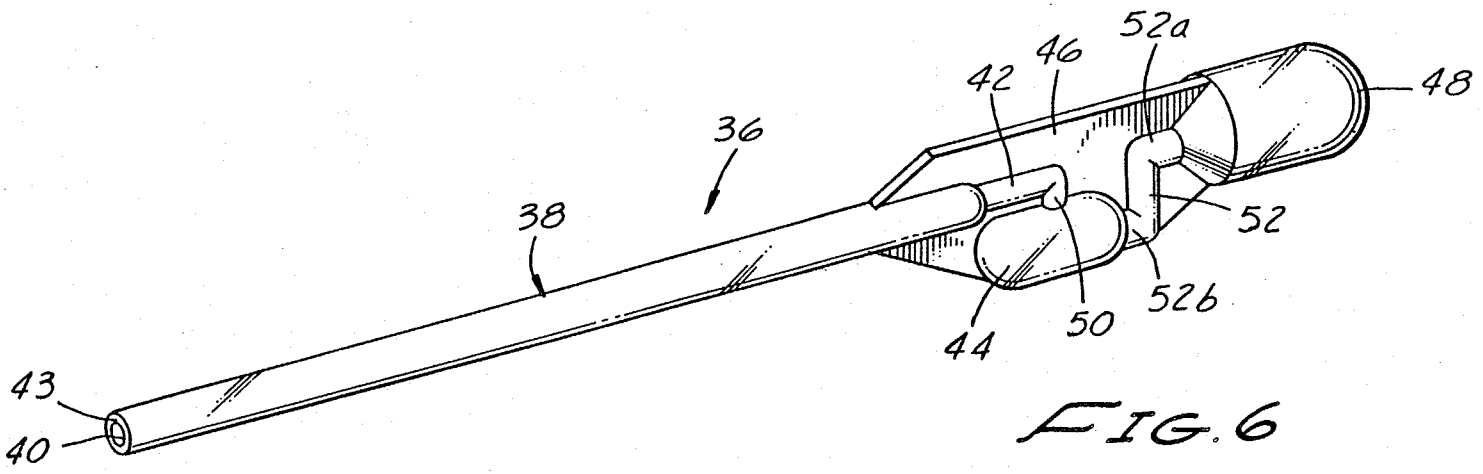
FIG. 6 is a generally perspective view of another form of pipette of the present invention.
Figure 7:
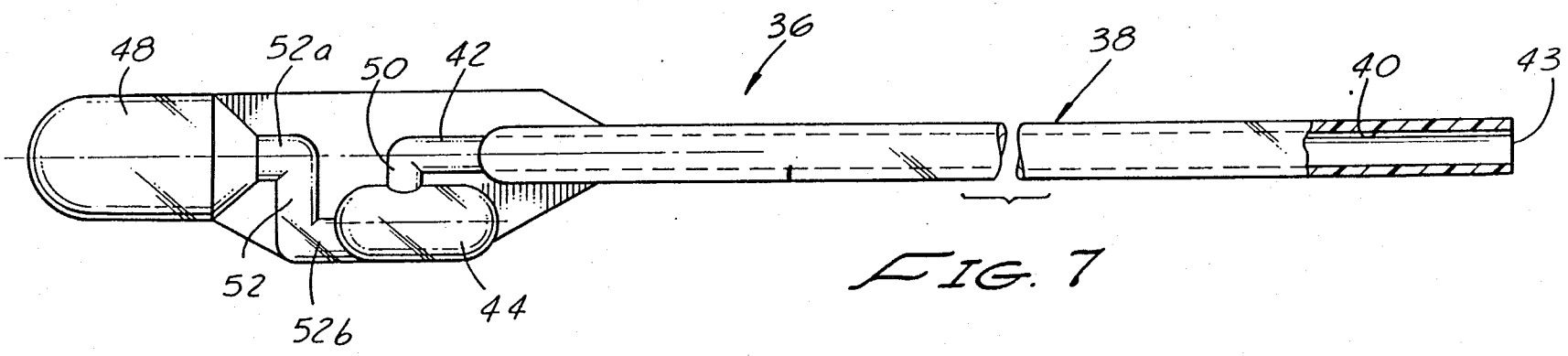
FIG. 7 is a side view of the pipette shown in FIG. 6.

Turning now to FIGS. 6 and 7, another embodiment of the volumetric dispensing pipette of the present invention, is there illustrated and generally designated by the numeral 36. The pipette of this form of the invention includes an elongated, hollow tube 38, having a centrally disposed axially extending fluid passageway 40 (FIG. 6) of a predetermined size having upper and lower ends 42 and 43 respectively. As indicated in FIG. 6, the lower end of passageway 40 is open to atmosphere. Connected proximate the upper end or left end of tube 38 as viewed in FIG. 6, is structural means 46 for structurally supporting a hollow, generally bulb shaped fluid reservoir 44. In the present embodiment of the invention structural means takes the form of a generally planar shaped longitudinally extending web 46.

An important aspect of the device of the invention is the fact that the axially centerline of fluid reservoir 44 is transversely spaced from axial centerline of the fluid passageway of tube 28. Another important feature of the invention resides in the fact that the lower end of bulb 44 is disposed below the upper end 42 of passageway 40 of tube 38.

Longitudinally spaced from reservoir 44 and from end 42, of passageway 40 is a hollow yieldably deformable squeeze bulb 48. Bulb 48 is axially aligned with passageway 40 but is out of axial alignment with bulb 44.

Interconnecting fluid reservoir 44 with the upper end 42 of passageway 44, is a generally perpendicularly extending first fluid conduit 50. As best seen in FIG. 7, fluid conduit 50 interconnects with fluid reservoir 44 proximate the central portion thereof. A second fluid conduit 52 interconnects hollow squeeze bulb 48 with fluid reservoir 44. Conduit 52 has two transversely spaced leg portions, namely leg 52*a* which is generally axially aligned with the centerline of bulb 48 and leg 52*b* which is transversely spaced from the axial centerline of bulb 48 and from the axially centerline of passageway 40 of tube 38.

With the arrangement described in the preceding paragraphs, a circuitous fluid path is defined between the upper end 42 of passageway 40 and the deformable hollow bulb 48. This arrangement positively precludes fluid being drawn into the device through passageway 44 from reaching bulb 48. Rather fluid being drawn into tube 38 will impinge upon perpendicularly extending conduit 50 and will be directed into fluid reservoir 44. Because a portion of fluid reservoir 44 is below the upper end 42 of passageway 40, any excess fluid, that is fluid amounts greater than the volume of the passageway 40, will drop by force of gravity into fluid reservoir 44. In similar fashion, because of the unique configuration of the device, once passageway 40 is filled with a predetermined volume of fluid, squeezing bulb 48 will cause the ejection of only the fluid contained within the fluid passageway, the excess fluid which was drawn into the device being safely contained within the lower portion of fluid reservoir 44.

Figure 8:
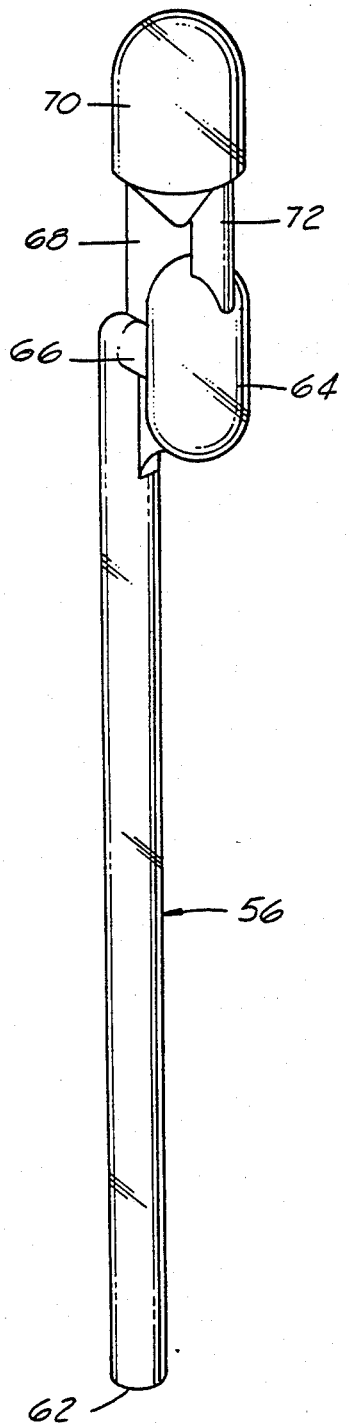
FIG. 8 is a generally perspective view of still another form of pipette of the present invention.
Figure 9:
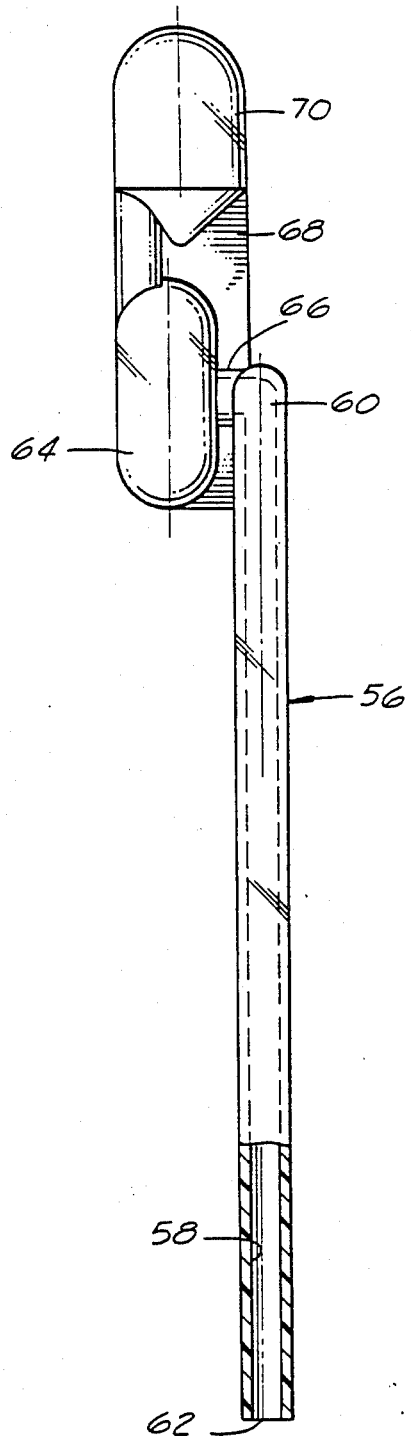
FIG. 9 is a side view of the pipette shown in FIG. 8.

Turning now to FIGS. 8 and 9, still another embodiment of the volumetric dispensing pipette of the invention, is there illustrated. In this embodiment of the invention, there is provided an elongated hollow tube 56, having a axially extending fluid passageway 58 of predetermined size and having upper nd lower ends, 60 and 62, the lower end being open to atmosphere.

As in the previously described forms of the invention, structural means are interconnected with tube 56 proximate the upper end thereof, for carrying a fluid reservoir designated in FIGS. 8 and 9 by the numeral 64. Once again a substantial portion of fluid reservoir 64 is disposed below the upper end 60 of passageway 58 of tube 56. A first fluid conduit 66 interconnects fluid reservoir 64 with the upper end 60 of fluid passageway 62. Once again, conduit 66 extends generally perpendicularly to the axial centerline of tube 56. As was the case with the embodiment of the invention shown in FIG. 6, the axial centerline of fluid reservoir 64 is transversely spaced apart from the axial centerline of tube 56.

Connected proximate the upper end of the structural means, or web 68, is a yieldably deformable hollow squeeze bulb 70. Unlike squeez bulb 48 of the previously described embodiment of the invention, the axial centerline of squeeze bulb 70 is transversely spaced from the axial centerline of tube 56. A second fluid conduit 72 interconnects squeeze bulb 70 with fluid reservoir 64. Once again it is important to note that the first fluid conduit 66, the fluid reservoir 64, and the second conduit 72, define a circuitous flow path between the upper end 60 of passageway 58 and the deformable hollow bulb 70. This circuitous path coupled with the fact that a portion of reservoir 64 is disposed below the upper end of passageway 60 prevents fluid from being accidentally drawn into the squeeze bulb 70 upon the squeezing and releasing of the squeeze bulb to draw fluid from a source of fluid upwardly into passageway 58 of tube 56. Any excess fluid beyond that necessary to fill the volume of passageway 58 will be forced through conduit 66 and will fall by force of gravity into the lower portion of fluid reservoir 64. The perpendicular orientation of fluid conduit 66 interrupts the fluid flow path of fluid being drawn into the device in a manner to positively prevent any accidental splashing of fluid into squeeze bulb 70.

As was the case with the earlier described embodiments of the invention, the various component parts of the device as previously described are preferably integrally formed by a blowmolding process wherein the entire pipette is formed as a single unit.

In using each of the previous described forms of the invention, the lower end of the elongated hollow tube is immersed in the liquid to be dispensed. The squeeze bulb is then collapsed so as to draw fluid from the source of fluid upwardly into the draw tube through the fluid passageway provided therein. Because of the unique positioning of the fluid overflow reservoirs, relative to the elongated tube, excess fluid will fall by force of gravity into the lower portion of the overflow fluid reservoirs. Upon once more squeezing the yieldably deformable hollow bulb to dispense fluid from the device, it is apparent that only the fluid contained within the axially extending passageway of the elongated tube will be expelled from the unit. By precisely controlling the length of the elongated tube and the diameter of the axially extending fluid passageway thereof, a predetermined, readily calculable volume of fluid can be repeatedly expelled from the device. Because of the circuitous flow path intentionally built into each of the embodiments of the invention, it is virtually impossible for fluid to be accidentally drawn or splashed into the squeeze bulb. The problem inherent in many prior art devices, that is the problem of fluid being accidentally drawn into the squeeze bulb and dispensed with the fluid in the passageway of the elongated tube, is thereby effectively avoided.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A volumetric dispensing pipette for dispensing precise, predetermined quantities of liquid, comprising:

(a) an elongated hollow tube having a centrally disposed, axially extending fluid passageway of predetermined size having upper and lower ends, the lower end being open to atmosphere;

(b) structural means connected to said tube proximate the upper end of said fluid passageway thereof for carrying at least one fluid reservoir;

(c) said at least one fluid reservoir being a generally bulb shaped, substantially closed fluid reservoir carried by said structural means having an axial centerline transversely spaced from the axial centerline of said fluid passageway of said tube;

(d) a first fluid conduit interconnecting said at least one fluid reservoir with the upper end of said fluid passageway of said tube;

(e) a yieldably deformable substantially closed hollow bulb connected to said structural means at a location proximate said at least one fluid reservoir;

(f) a second fluid conduit interconnecting said hollow bulb and said at least one fluid reservoir, said first fluid conduit, said at least one fluid reservoir and said second fluid conduit defining a circuitous fluid flow path between said upper end of said fluid passageway of said tube and said deformable hollow bulb.

2. A volumetric dispensing pipette as defined in claim 1 in which at least a portion of said at least one fluid reservoir is below the upper end of said fluid passageway of said tube.

3. A volumetric dispensing pipette as defined in claim 1 in which two transversely spaced fluid reservoirs are carried by said structural means.

4. A volumetric dispensing pipette as defined in claim 3 in which said structural means comprises a generally planar shaped web of plastic material.

5. A volumetric dispensing pipette as defined in claim 3 in which said two transversely spaced fluid reservoirs are interconnected by a fluid conduit extending generally perpendicular to said fluid passageway of said tube.

6. A volumetric dispensing pipette as defined in claim 4 in which said first and second conduits are integrally formed with said web.

7. A volumetric dispensing pipette for dispensing precise, predetermined quantities of liquid, comprising:

(a) an elongated hollow tube having an axial centerline and a centrally disposed, axially extending fluid passageway of predetermined size having upper and lower ends, the lower end being open to atmosphere;

(b) a generally planar longitudinally extending web integrally formed with said tube proximate the upper end of said fluid passageway thereof;

(c) a generally bulb shaped, substantially closed first fluid overflow reservoir integrally formed with said web, said fluid reservoir having an axial centerline transversely spaced from the axial centerline of said fluid passageway of said tube;

(d) a generally bulb shaped substantially closed second fluid overflow reservoir integrally formed with said web, said second fluid overflow reservoir having an axial centerline transversely spaced both from the axial centerline of said fluid passageway of said tube and from the axial centerline of said first fluid overflow reservoir;

(e) a fluid overflow reservoir connecting conduit connecting said first and second fluid overflow reservoirs and extending generally perpendicular to the axial centerline of said tube;

(f) a yieldably of deformable substantially closed hollow bulb integrally formed with said web proximate said first and second fluid overflow reservoirs;

(g) a first fluid conduit interconnecting said upper end of said fluid passageway of said tube with said fluid overflow rsservoir connecting conduit; and (h) a second fluid conduit interconnecting said hollow bulb and said first and second fluid overflow reservoirs.

8. A pipette as defined in claim 7 in which said second fluid conduit includes a first leg extending generally perpendicular to the axial centerline of said tube; a second leg interconnecting said first fluid overflow reservoir with said first leg of said second fluid conduit; and a third leg interconnecting said second fluid overflow reservoir with said first leg of said second fluid conduit.

9. A pipette as defined in claim 8 in which said hollow bulb is axially aligned with the axial centerline of said tube.

10. A pipette as defined in claim 9 in which said first and second conduits are integrally formed with said web.

* * * * *